United States Patent [19]

Taniguchi

[11] 4,207,064

[45] Jun. 10, 1980

[54] HEATING APPARATUS

[75] Inventor: Toru Taniguchi, Kyoto, Japan

[73] Assignee: Nikku Industry Co., Ltd., Hyogo, Japan

[21] Appl. No.: 875,375

[22] Filed: Feb. 6, 1978

[30] Foreign Application Priority Data

Jul. 18, 1977 [JP] Japan ..... 52-85927

[51] Int. Cl.[2] ..... F27B 9/00

[52] U.S. Cl. ..... 432/145; 432/152; 432/199; 432/207; 432/250

[58] Field of Search ..... 432/128, 130, 145, 152, 432/199, 207, 250

[56] References Cited

U.S. PATENT DOCUMENTS

| | | | |
|---|---|---|---|
| 2,458,040 | 1/1949 | Weller | 432/145 |
| 2,713,480 | 7/1955 | Ruckstahl | 432/128 |
| 3,581,679 | 1/1971 | Jansen et al. | 432/152 |
| 3,850,318 | 11/1974 | Wentworth | 432/128 |
| 3,982,887 | 9/1976 | Kendziora et al. | 432/128 |

OTHER PUBLICATIONS 5 pages of "Chemical Apparatus Encyclopaedia" Enlarged Edition Published by K. K. Kaguko Kogya Sha May 25, 1976.

*Primary Examiner*—John J. Camby
*Attorney, Agent, or Firm*—Armstrong, Nikaido, Marmelstein & Kubovcik

[57] ABSTRACT

A heating apparatus having doors mounted on the inlet and outlet of a furnace body to cover them and at least one additional door disposed in an intermediate portion of the furnace body to divide it into compartment furnace chambers forming a preheating chamber, a heating chamber and/or a warmth-keeping chamber, from the inlet side to the outlet side. A hot air circulating device is disposed in each of the compartment furnace chambers in a manner such that areas close to each door are much heated. When a material to be heated is charged from the preheating chamber, outer air is shut off from the heating chamber, and when the material to be heated is delivered into the heating chamber, outer air is shut off from the preheating chamber. When the material is shifted from the heating chamber to the warmth-keeping chamber or is discharged to the outside from the warmth-keeping chamber, outer air is shut off in the same manner as above.

3 Claims, 4 Drawing Figures

HEATING APPARATUS

BACKGROUND OF THE INVENTION (1) Field of the Invention

The present invention relates to a heating apparatus in which leakage of hot air from the interior of the furnace is markedly reduced even when a material to be heated is charged into or delivered out of the heating furnace.

(2) Description of the Prior Art

In conventional heating apparatus, an inlet or outlet for a material to be heated is kept open or doors are mounted for the inlet and outlet.

In these conventional heating apparatuses, the entire length of the furnace is increased so that even if the temperature is lowered in the vicinity of the inlet or outlet, the change of the temperature is eliminated or reduced in the central portion of the furnace.

If the length of the furnace is thus increased, a large quantity of a furnace-constituting material must be used and the manufacturing cost of the furnace is increased. Moreover, a large area is necessary for construction of such heating apparatus, and the scale of the entire equipment including this heating apparatus is inevitably increased.

Especially in case of a heating apparatus for use in manufacture of carbon electrodes to be used for a metal melting electric furnace, this problem is very serious because a material to be heated, namely a graphite electrode, has considerable size and weight (for example, such graphite electrode has a diameter of 60 cm and a length of 200 cm).

When such material to be heated is charged into or delivered from the heating apparatus by means of a conveyor device or the like, the changing or delivery movement is performed at a low speed because the weight of the material is heavy. Accordingly, the door at the inlet or outlet of furnace must be opened for a long time.

Furthermore, when graphite electrodes are heated by the above-mentioned conventional heating apparatus, the length of the furnace must be remarkably increased.

Accordingly, it has been eagerly desired to develop a heating apparatus in which the furnace length can be reduced and the temperature in the furnace can be maintained at a high level during the charging or delivery operation even if the furnase length is shortened.

OBJECTS OF THE INVENTION

The heating apparatus of the present invention has now been completed as a result of our research and investigation made for a long time with a view to solving the foregoing problems involved in the conventional heating apparatus.

It is therefore a primary object of the present invention to provide a heating apparatus in which the temperature distribution is kept constant in the heating apparatus, especially in the heating chamber thereof, so as to maintain a thermal efficiency at a high level.

Another object of the present invention is to provide a heating apparatus in which the temperature in the vicinity of an inlet or outlet of the heating apparatus is not lowered.

Still another object of the present invention is to provide a heating apparatus in which the length of the furnace is made as short as possible.

A further object of the present invention is to provide a heating apparatus in which even if a material to be heated is heavy and it is charged into or delivered from the heating apparatus at a very low speed, any trouble or disadvantage is caused.

BRIEF SUMMARY OF THE INVENTION

In accordance with the present invention, the foregoing objects can be attained by heating apparatus comprising doors disposed at inlet and outlet of a furnace body to cover openings formed at said inlet and outlet of the furnace body and at least one door disposed in an intermediate portion of the furnace chamber of the furnace body to partition said furnace chamber of the furnace body, said furnace chamber of the furnace body being divided into independent compartment furnace chambers by said doors and a hot air circulating device being disposed in each of said compartment furnace chambers.

More specifically, in accordance with the present invention the foregoing objects can be attained by a heating apparatus in which one door is disposed in an intermediate portion of a furnace chamber of a furnace body to partition the furnace chamber into two compartment furnace chambers, one located on the inlet side of the furnace body forming a preheating chamber and the other located on the outlet side forming a heating chamber; hot air to be introduced and discharged by a hot air circulating device disposed in the preheating chamber is blown into the preheating chamber from below the floor of the preheating chamber toward the inlet side of the furnace body and this hot air is discharged from the ceiling portion of the preheating chamber on the side of said heating chamber; and in which hot air to be introduced and discharged by a hot air circulating device disposed in the heating chamber is blown into the heating chamber from below the floor of the heating chamber toward the outlet side of the furnace body and this hot air is discharged from the ceiling portion of the heating chamber on the side of the preheating chamber.

In accordance with the present invention, the foregoing objects can also be attained by a heating apparatus in which two doors are disposed in intermediate portions of a furnace chamber of a furnace body to partition the furnace chamber into three compartment furnace chambers, a first one located on the inlet side of the furnace body being designated as a preheating chamber, a second one located on the outlet side being designated as a warmth-keeping chamber and the other one located between said two compartment furnace chambers being designated as a heating chamber; hot air to be introduced into and discharged from the preheating chamber by a hot air circulating device disposed in said preheating chamber is blown into the preheating chamber from below the floor of the preheating chamber toward the inlet side of the furnace body and this hot air is discharged from the ceiling portion of the preheating chamber on the side of heating chamber; hot air to be introduced into and discharged from the warmth-keeping chamber by a hot air circulating device disposed in said warmth-keeping chamber is blown into the warmth-keeping chamber from below the floor of the warmth-keeping chamber toward the outlet side of the furnace body and this hot air is discharged from the ceiling portion of the warmth-keeping chamber on the side of said heating chamber; and in which hot air to be introduced into and discharged from the heating chamber by a hot air circulating device disposed in said heating chamber is blown into the heating chamber from below the floor of the heating chamber toward both said preheating chamber and said warmth-keeping chamber and this hot air is discharged from the ceiling portion of the heating chamber.

The foregoing and other objects of the present invention can be attained by the structures described in detail hereinafter, illustrated in the accompanying drawings and set forth in the appended claims. Further, even if various modifications are made to the operation, shapes, sizes and structural details within the scope of the claims, these modifications will not be contrary to the spirit of the invention nor sacrifice any of advantages of the invention.

BRIEF DESCRIPTION OF THE DRAWINGS

The drawings illustrate embodiments of the present invention, in which.

DETAILED DESCRIPTION OF THE PREFERRED EMBODIMENTS

Figure 1:
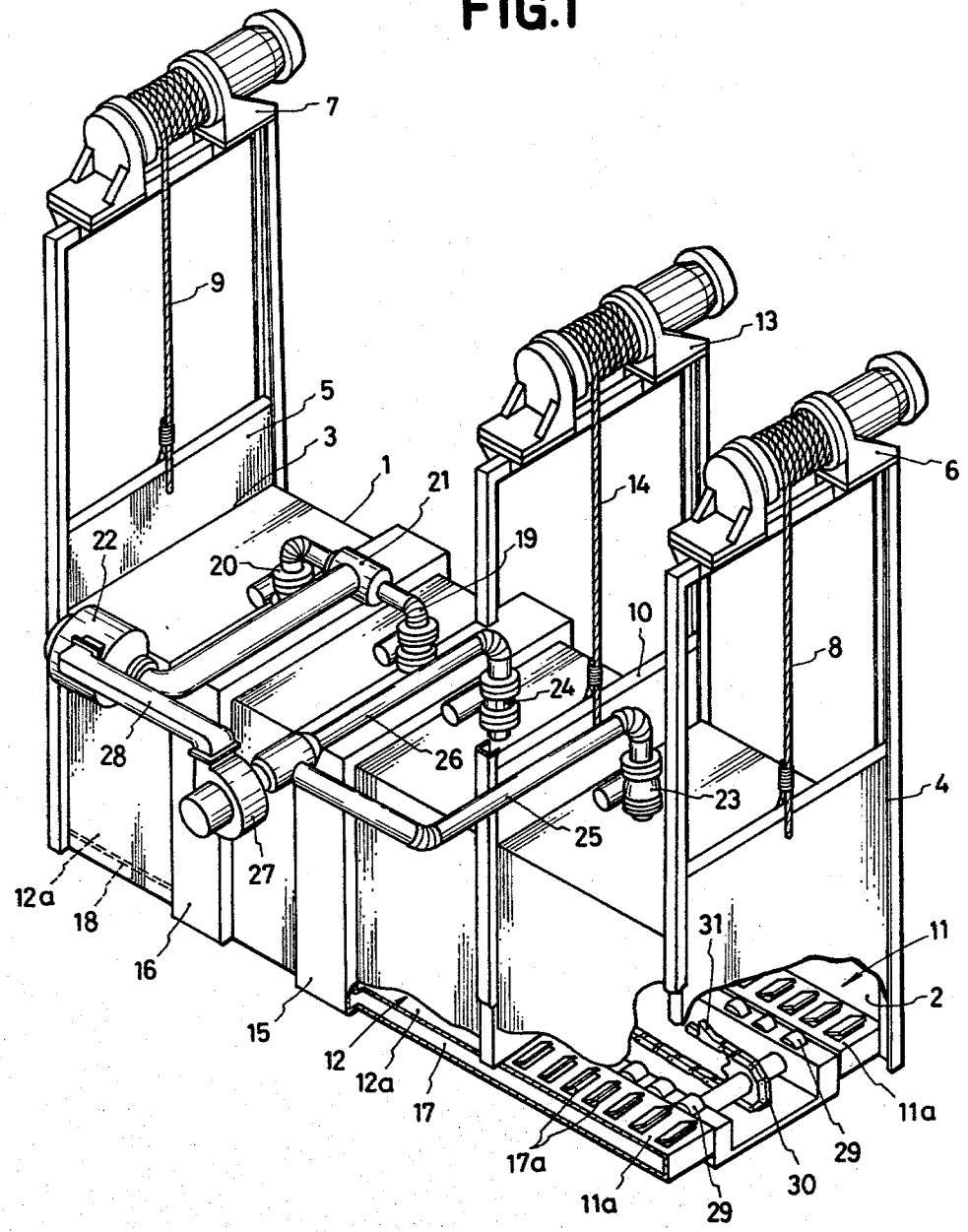
FIG. 1 is a perspective general view, illustrating one embodiment of the heating apparatus of the present invention, which is partially cut out so as to show the interior.
Figure 2:
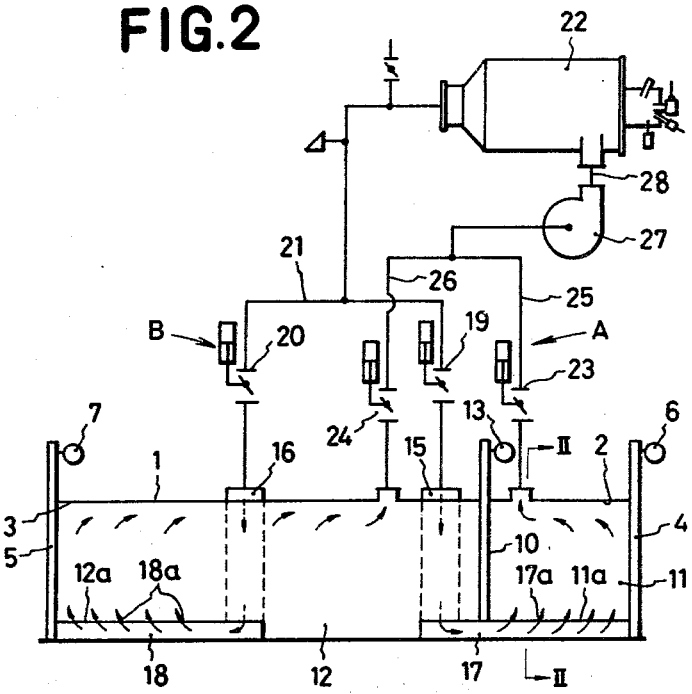
FIG. 2 is a diagram, illustrating the relation between the heating furnace and hot air circulating devices in the heating apparatus shown in FIG. 1.
Figure 3:
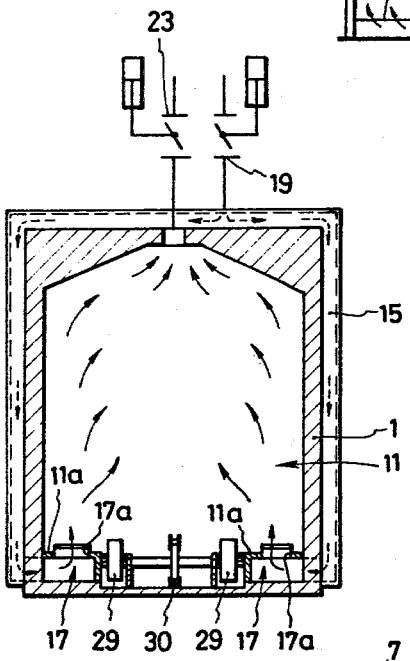
FIG. 3 is a view showing the section taken along the line II—II in FIG. 2.

The present invention will now be described initially in connection with a first embodiment thereof which is illustrated in FIGS. 1 to 3.

Structure

In FIGS. 1 to 3, front and rear doors 4 and 5 are mounted on the inlet 2 and outlet 3 disposed in the front and rear of a furnace body or heating furnace 1, respectively, so that they are opened and closed in the vertical direction. Hoists 6 and 7 are mounted above the doors 4 and 5 to move the doors 4 and 5 in the vertical direction, respectively, and wire ropes 8 and 9 are wound on the hoists 6 and 7. The lower ends of these wire ropes 8 and 9 are fixed to the upper portions of the front and rear doors 4 and 5, respectively, so that when the wire rope 8 or 9 is wound up by the hoist 6 or 7, the front or rear door 4 or 5 is moved upwardly to open the inlet 2 or outlet 3 of the furnace body 1. When the inlet 2 or outlet 3 is closed, the front or rear door 4 or 5 is moved downwardly by its own weight to block up the inlet 2 or outlet 3. In an intermediate portion of the furnace 1, a middle door 10 that can be opened and closed in the vertical direction is disposed to divide the furnace chamber of the furnace body into front and rear compartments. Namely, a preheating chamber 11 is formed in the front portion of the furnace body 1 and a heating chamber 12 is formed in the rear portion of the furnace. A hoist 13 is disposed above the middle door 10 to move it in the vertical direction. The lower end of a wire rope 14 wound on the hoist 13 is fixed to the upper portion of the middle door 10 so that the middle door 10 is operated in the same manner as the front and rear doors 4 and 5.

Hot air introducing ducts 15 and 16 are mounted on the outer periphery of the furnace body 1 to surround the outer peripheral face of the furnace. One hot air introducing duct 15 is communicated with an introduction passage 17 laid out below the floor of the furnace 1 and is extended to the preheating chamber 11. The other hot air introducing duct 16 is communicated with an introduction passage 18 laid out below the floor of the furnace 1 and is extended to the heating chamber 12. Through holes 17*a* communicating the preheating chamber 11 with the introduction passage 17 and through holes 18*a* communicating the heating chamber 12 with the introduction passage 18 are formed on floor faces 11*a* and 12*a* of the preheating chamber 11 and heating chamber 12, respectively. The through holes 17*a* are opened so that hot air flows toward the inlet 2, and the through holes 18*a* are opened so that hot air flows toward the outlet 3.

Hot air introducing valves 19 and 20 are laid out above the hot air introducing ducts 15 and 16 and are communicated therewith. These valves 19 and 20 are communicated with a pipe passage 21 outside the heating furnace 1 and the outer end of the pipe passage 21 is extended to a hot air generating furnace 22.

In the ceilig portion of the middle door 10, hot air discharge valves 23 and 24 communicated with the preheating chamber 11 and heating chamber 12 are disposed with the door 10 being as a boundary. These valves 23 and 24 are communicated with pipe passages 25 and 26 extending outwardly of the furnace 1, respectively. These pipe passages 25 and 26 join to form a passage connected to an intake opening of a hot air circulating blower 27. A discharge opening of the blower 27 is connected to the hot air generating furnace 22 through a duct 28. Thus, hot air circulating devices A and B are constructed.

As shown in FIG. 1, roller conveyors 29 are laid out on the floors of the preheating chamber 11 and heating chamber 12 of the furnace 1, and a chain conveyor 30 is disposed in the central portion between the roller conveyors 29 so that a material to be heated (not shown) is transported by carriers 31 fixed to attachments of the chain.

Operation

The operation of the heating apparatus having the above-mentioned structure will now be described by reference to the case where graphite electrodes (not shown) to be used for an electric furnace are heated.

A graphite electrode fed to the heating apparatus by a conveyor or the like (not shown) is delivered in the state loaded on a pallet at a very low speed because of a heavy weight thereof. When the graphite electrode arrives at a point close to the front door of the heating furnace, a signal of detection of arrival of the graphite electrode is sent to the hot air discharge valve 23 and hot air introducing valve 19, and these valves are closed to stop circulation of hot air in the preheating chamber 11. The signal which has closed the hot air discharge valve 23 and hot air introducing valve 19 is then sent to the hoist 6 to actuate the hoist 6 to bring up the front door 4 and open the inlet 2. Thus, the graphite electrode is gradually and slowly charged into the preheating chamber 11. Then, a signal indicating completion of charging of the graphite electrode into the preheating chamber 11 is sent to the hoist 6, and the front door 4 is brought down by its own weight and the preheating chamber 11 is shut off from outer air. Then, the hot air introducing valve 19 and hot air discharge valve 23 are opened to supply hot air, which is fed from the hot air generating furnace 22 through the hot air introducing duct 15 and hot air introducing passage 17, into the preheating chamber 11 on the side of the inlet 2. At this point low-temperature air in the preheating chamber 11, especially air present in the vicinity of the inlet 2, is sucked from hot air discharge valve 23 through the pipe passage 25 by the circulating blower 27 and is then fed to the hot air generating furnace 22 by the blower 27. In the hot air generating furnace 22, this low-temperature air is heated again and fed into the preheating chamber 11. The graphite electrode is preheated in the preheating chamber 11 by thus circulated hot air. Accordingly, even if the temperature of hot air in the preheating chamber, especially in the area close to the inlet 2, is temporarily lowered by opening and closing of the door 4, the temperature is quickly elevated by the above-mentioned operation of circulating hot air and substantially uniform temperature distribution can be maintained in the preheating chamber 11.

After a certain time has passed, a signal indicating completion of preheating of the graphite electrode is emitted and sent to the hoist 13, and the hoist 13 is actuated to open the middle door 10. The heating chamber 12 has been heated in advance and there is no substantial difference of the temperature between the preheating chamber 11 and heating chamber 12. Accordingly, the temperature distribution in the heating chamber 12 is not disturbed by opening of the middle door 10. Therefore, the graphite electrode in the preheating chamber 11 is delivered into the preheating chamber 12 while the respective valves are kept open. A signal indicating completion of delivery of the graphite electrode into the heating chamber 12 is sent to the hoist 13 and the middle door 10 is brought down by its own weight to separate the heating chamber 12 from the preheating chamber 11. Separately, a cool subsequent graphite electrode is charged into the preheating chamber 11 which has been empty according to the same procedure as described above. Even if the temperature of the preheating chamber 11 lowered by charging of the subsequent graphite electrode, the temperature in the heating chamber 12 is not influenced at all.

When the heated graphite electrode is discharged from the furnace, a signal indicating completion of the heating operation is sent to the hot air introducing valve 20 and hot air discharge valve 24 to close these valves, whereby circulation of hot air in the heating chamber 12 is stopped. Then, this signal is sent to the hoist 7 to actuate it to open the rear door 5, and the heated graphite electrode is discharged from the furnace. At this point, cold outer air is going to enter into the heating chamber 12, but since the graphite electrode is heated, cold air is heated by the graphite electrode while it passes around the heated graphite electrode. Accordingly, the change of the temperature in the heating chamber is markedly reduced.

After the graphite electrode has been discharged to the outside, a signal indicating the position of the graphite electrode is sent to the hoist 7, and the door 5 is brought down by its own weight and the heating chamber 12 is separated from the outside. Then, the hot air introducing valve 20 and hot air discharge valve 24 are opened and hot air, which is fed from the hot air generating furnace 22 through the hot air introducing duct and hot air introducing passage 18, is fed into the heating chamber 12 on the side of the outlet 3. At this point, low temperature air in the heating chamber 12, especially air present in the vicinity of the outlet 3 (the air has been heated by the heated graphite electrode and the temperature of the air is higher than the temperature of air present in the vicinity of the inlet 2 of the preheating chamber 11), is sucked from the hot air discharge valve 24 by the hot air circulating blower 27 through the pipe passage 26, and it is then fed to the hot air generating furnace 22. Air is heated again in the hot air generating furnace 22 and fed into the heating chamber 12.

Accordingly, even if the temperature of air in the heating chamber, especially air present in the vicinity of the outlet 3, is temporarily lowered by opening and closing of the door 5, the temperature in the heating chamber 12 can be quickly elevated to a level much higher than the temperature in the preheating chamber 11 by this hot air-circulating operation and the influence of the heated graphite electrode and substantially uniform temperature distribution can be maintained in the heating chamber 12.

A second embodiment of the present invention will now be described by reference to FIG. 4, which is a diagram illustrating the relation between the heating furnace and hot air circulating devices. Only modifications and changes made to the above-mentioned first embodiment will be mainly described.

Structure

Figure 4:
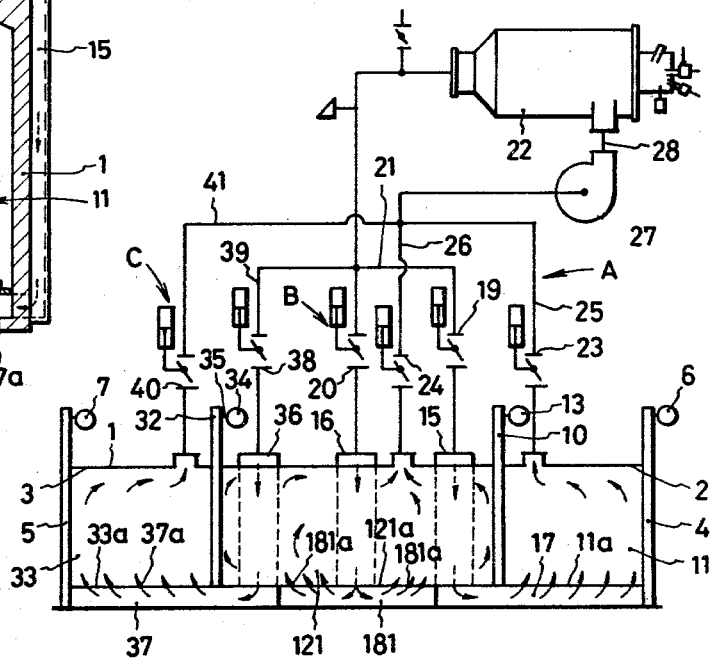
FIG. 4 is a diagram, illustrating the relation between the heating furnace and hot air circulating devices in another embodiment of the heating apparatus of the present invention.

Referring to FIG. 4, a heating chamber 121 is partitioned in the rear part thereof by a rear middle door 32 to divide the heating chamber 121 into two compartment chambers, one located on the outlet side of the furnace 1 being a warmth-keeping chamber 33. A hoist 34 is disposed above the rear middle door 32 to move the door 32 in the vertical direction. The lower end of a wire rope 35 wound on the hoist 34 is fixed to the upper portion of the rear middle door 32. This rear middle door 32 is operated by the hoist 34 in the same manner as the respective doors illustrated in the first embodiment.

A hot air introducing duct 36 is disposed on the outer periphery of the furnace 1 to surround the outer peripheral face of the furnace. The hot air introducing duct 36 is communicated with an introduction passage 37 laid out below the floor of the furnace 1 and is extended to the warmth-keeping chamber 33.

A number of through holes **37*a* are formed on the floor face 33*a* of the warmth-keeping chamber 33 to communicate the warmth-keeping chamber 33 with the introduction passage 37. The through holes 37*a* are opened so that hot air flows toward the outlet 3**.

A hot air introducing valve 38 communicated with the hot air introducing duct 36 is disposed above the hot air introducing duct 36. This valve 38 is connected to a pipe passage 39 outwardly of the furnace body 1, and the outer end of the pipe passage 39 is extended to the hot air generating furnace 22 disposed outside the furnace body 1.

A hot air discharge valve 40 is disposed on the ceiling portion of the warmth-keeping chamber 33 on the side of the rear middle door 32 and is communicated therewith. This discharge valve 40 is connected to a pipe passage 41 extended outwardly of the furnace 1. This pipe passage 41 joins with the pipe passages 25 and 26 to form a passage communicated with an intake opening of the air circulating blower 27.

A hot air circulating device C is thus constructed.

A hot air introducing passage 181 on the floor face 121*a* of the heating chamber 121 is divided into two independent parts, the part on the side of the hot air circulating passage 37 of the warmth-keeping chamber 33 and the part on the side of the hot air introducing passage 17 of the preheating chamber 11. A number of through holes 181*a* are formed on the floor face 121*a* of the heating chamber 121 and they are communicated with this hot air introducing passage 181. These through holes 181*a* are different with respect to the opening direction. More specifically, a half of these through holes 181*a* are opened toward the warmth-keeping chamber 33 and the other half of the through holes 181*a* are opened toward the preheating chamber 11.

Operation

The operation of the heating apparatus of the second embodiment having the above-mentioned structure will now be described mainly by reference to the delivery of graphite electrodes from the heating chamber 121 to the warmth-keeping chamber 33.

When heating of a graphite electrode which has been heated in the heating chamber 121 is completed, a signal indicating completion of the heating is sent to the hoist 34 to actuate it to bring up the rear middle door 32. At this point, the hot air introducing valve 20 of the heating chamber 121 and the hot air discharge valve 24 of the heating chamber 121 need not be closed because there is no substantial difference of the temperature between the heating chamber 121 and the warmth-keeping chamber 33.

When the graphite electrode is charged into the warmth-keeping chamber 33, a signal of completion of the charging of the graphite electrode is sent to the hoist 34, and the rear middle door 32 is brought down by its own weight to separate the warmth-keeping chamber 33 from the heating chamber 121.

A subsequent graphite electrode which has been delivered into the warmth-keeping chamber 33 from the heating chamber 121 is discharged from the warmth-keeping chamber 33 to the outside of the furnace, a signal indicating separation of the warmth-keeping chamber 33 from the heating chamber 121 by the rear middle door 32 is sent to the hot air introducing valve 38 and hot air discharge valve 40 to close these valves and to shut off hot air in the warmth-keeping chamber 33 from other zones, and this signal is sent to the hoist 7 to actuate it to open the rear door 5 for discharging the heated graphite electrode to the outside of the furnace. At this point, hot air in the warmth-keeping chamber 33 is discharged to the outside of the furnace and cold outer air is going to enter into the warmth-keeping chamber 33. However, since the graphite electrode is heated, when cold air passes around the graphite electrode, it is heated and the change of the temperature in the warmth-keeping chamber 33 is much reduced.

After the graphite electrode has been discharged from the furnace, a signal indicating the position of the graphite electrode is sent to the hoist 7 and the rear door 5 is brought down by its own weight to shut off the warmth-keeping chamber 33 from the outside of the furnace. Then, the hot air introducing valve 38 and hot air discharge valve 40 are opened, and hot air, which is fed from the hot air generating furnace 22 through the hot air introducing duct 39 and hot air introducing passage 36, to the warmth-keeping chamber 33 on the side of outlet 3 from the hot air introducing valve 38. At this point, low-temperature air in the warmth-keeping chamber 33, especially air present in the vicinity of the outlet 3 (since the cold air is heated by the heated graphite electrode, the temperature of the air is much higher than the temperature of air present in the vicinity of the inlet 2 of the preheating chamber 11), is sucked from the hot air discharge valve 40 through the pipe passage 41 by the air circulating blower 27 and is then fed to the hot air generating furnace 22 where the introduced air is heated again.

Accordingly, even if the temperature of air in the warmth-keeping chamber 33, especially air present in the vicinity of the outlet 3, is temporarily lowered by opening and closing of the rear door 7, the temperature is elevated more quickly than in the preheating chamber 11 by the hot air circulating operation and the influence of the graphite electrode, and the temperature distribution in the warmth-keeping chamber 33 can be kept substantially uniform.

Incidentally, hot air blown into the heating chamber 121 passes through the neighbouring areas of the middle door 10 and rear middle door 32 from the through holes 181*a* and is discharged from the ceiling portion of the heating chamber 121. Accordingly, the difference of the temperature either between the heating chamber 121 and the warmth-keeping chamber 33 or between the heating chamber 121 and the preheating chamber 11 can be substantially eliminated. By virtue of this feature as well as the heating action of hot air in the heating chamber 121, the temperature distribution can always be kept substantially uniform in the heating chamber 121.

What is claimed is:

1. A heating apparatus comprising a furnace body having an inlet opening with a first door covering said inlet opening, an outlet opening with a second door covering said outlet opening, and at least one partition door disposed between said inlet and outlet openings, said doors dividing said furnace body into at least two independent chambers, each of said independent chambers having hot air director means on the bottom thereof and air outlet means at the top thereof, wherein the hot air director means of the chamber having said inlet opening directs hot air towards the inlet opening, the hot air director means of the chamber having said outlet opening directs hot air towards the outlet opening, and the hot air director means of the others of said at least three chambers directs hot air towards said inlet opening in the chambers located closer to the inlet opening and towards said outlet opening in the chambers located closer to the outlet opening, and the air outlet means of said chamber having the inlet opening being located remote from the inlet opening, the air outlet means of said chamber having the outlet opening being located remote from the outlet opening.

2. A heating apparatus comprising (a) a furnace body having a preheating chamber including an inlet opening and a heating chamber including an outlet opening;

(b) an inlet door for covering the inlet opening of said preheating chamber;

(c) an outlet door for covering the outlet opening of said heating chamber;

(d) a partition door between said preheating chamber and said heating chamber for separating said chambers;

(e) first hot air circulating means in said preheating chamber for circulating hot air therein, said first hot air circulating means including first air director means located at the bottom of said preheating chamber for directing hot air into said preheating chamber in a direction towards said inlet opening, and first air outlet means located at the top of said preheating chamber adjacent said partition door, for drawing air from said preheating chamber in a direction from said inlet door towards said partition door; and (f) second hot air circulating means in said heating chamber for circulating hot air therein, said second hot air circulating means including second air director means located at the bottom of said heating chamber for directing hot air into said heating chamber in a direction towards said outlet opening, and second air outlet means located at the top of said heating chamber adjacent said partition door, for drawing air from said heating chamber in a direction from said outlet door towards said partition door.

3. A heating apparatus comprising:

(a) a furnace body having a preheating chamber including an inlet opening, a warmth keeping chamber including an outlet opening, and a heating chamber positioned between said preheating chamber and said warmth keeping chamber;

(b) an inlet door for covering the inlet opening of said preheating chamber;

(c) an outlet door for covering the outlet opening of said warmth keeping chamber;

(d) a first partition door between said preheating chamber and said heating chamber for separating said chambers;

(e) a second partition door between said warmth keeping chamber and said heating chamber for separating said chambers;

(f) first hot air circulating means in said preheating chamber for circulating hot air therein, said first hot air circulating means including first air director means located at the bottom of said preheating chamber for directing hot air into said preheating chamber in a direction towards said inlet opening, said first air outlet means located at the top of said preheating chamber adjacent said first partition door for drawing air from said preheating chamber in a direction from said inlet door towards said first partition door;

(g) second hot air circulating means in said warmth keeping chamber for circulating air therein, said second hot air circulating means including second air director means located at the bottom of said warmth keeping chamber for directing hot air into said warmth keeping chamber in a direction towards said outlet opening and second air outlet means located at the top of said warmth keeping chamber adjacent said second partition door, for drawing air from said heating chamber in a direction from said outlet door towards said second partition door; and (h) third air circulating means in said heating chamber, said third air circulating means including third air director means located at the bottom of said heating chamber for directing hot air towards said first and second partition doors and third air outlet means located at the top of said heating chamber for drawing the hot air therefrom.

* * * * *